US010202783B2

(12) United States Patent
Pan

(10) Patent No.: US 10,202,783 B2
(45) Date of Patent: Feb. 12, 2019

(54) ROOF CANOPY FOR AN OUTDOOR SHELTER

(71) Applicant: Sunjoy Industries Group Ltd., Steubenville, OH (US)

(72) Inventor: Lianzhang Pan, Huzhou (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 15/634,195

(22) Filed: Jun. 27, 2017

(65) Prior Publication Data

US 2018/0371786 A1 Dec. 27, 2018

(51) Int. Cl.

| | |
|---|---|
| ***E04H 15/64*** | (2006.01) |
| ***E04H 15/34*** | (2006.01) |
| ***E04H 15/54*** | (2006.01) |

(52) U.S. Cl.

CPC ..... *E04H 15/64* (2013.01); *E04H 15/34* (2013.01); *E04H 15/54* (2013.01)

(58) Field of Classification Search

CPC ..... E04H 15/54; E04H 15/64; E04H 15/34; E04H 15/32; E04H 15/16

USPC ..... 135/121, 145–147, 159–160, 115, 119, 135/907, 120.1–120.3; 52/63, 83, 96, 222

See application file for complete search history.

(56) References Cited

U.S. PATENT DOCUMENTS

| | | | |
|---|---|---|---|
| 1,958,296 | A | 5/1934 | Crow |
| 2,265,479 | A | 12/1941 | Goodman |
| 2,836,860 | A | 6/1958 | Staropoli |
| 3,333,373 | A | 8/1967 | Taylor et al. |
| 3,952,463 | A | 4/1976 | Lane |
| 4,066,089 | A | 1/1978 | Rainwater |
| 4,229,915 | A | 10/1980 | Snow et al. |
| 4,558,713 | A | 12/1985 | Hagler et al. |
| 4,726,153 | A | 2/1988 | Adler et al. |

(Continued)

FOREIGN PATENT DOCUMENTS

| | | | |
|---|---|---|---|
| JP | 2002138713 | A | 5/2002 |
| WO | 9827296 | A1 | 6/1998 |

OTHER PUBLICATIONS

Use and Care Guide for Lansing Gazebo, Hampton Bay, manufactured by Sunjoy Industries, pp. 1-9, dated Oct. 2002.

(Continued)

*Primary Examiner* — Winnie Yip

(74) *Attorney, Agent, or Firm* — The Law Office of Patrick F. O'Reilly III, LLC

(57) ABSTRACT

A roof canopy for an outdoor shelter is disclosed herein. The roof canopy includes a canopy fabric material configured to form a roof cover of an outdoor shelter; a pocket structure attached to a second surface of the canopy fabric material, the pocket structure including a pocket fabric sheet at least partially spaced apart from the canopy fabric material, the pocket fabric sheet and the canopy fabric material together defining a pocket cavity configured to receive an end portion of a roof frame member of the outdoor shelter therein; and a handle member attached to a first surface of the canopy fabric material, the handle member overlapping at least a portion of the canopy fabric material that partially defines the pocket cavity, the handle member configured to be grasped by a user so as to facilitate the pocket structure being fitted over the end portion of the roof frame member.

20 Claims, 6 Drawing Sheets

Detail "B"

(56) References Cited

U.S. PATENT DOCUMENTS 4,733,508 A 3/1988 Greenblatt
4,914,768 A 4/1990 Howard
4,948,289 A 8/1990 Dellinger
5,115,828 A 5/1992 Spaulding
5,226,440 A 7/1993 Fuhrman
5,335,685 A 8/1994 Dahulich
5,441,066 A * 8/1995 Harris ..... B63B 17/02 135/88.01
5,511,572 A 4/1996 Carter
5,579,796 A 12/1996 Mallo et al.
5,632,293 A 5/1997 Carter
5,661,942 A 9/1997 Palmer
5,779,386 A 7/1998 Eichhorn
6,089,247 A 7/2000 Price
6,173,726 B1 1/2001 Talmadge
6,200,060 B1 3/2001 Vernay
6,206,020 B1 3/2001 Lynch
6,216,717 B1 4/2001 Chen
6,283,136 B1 9/2001 Chen
6,470,901 B1 * 10/2002 Scherer ..... E04H 15/322 135/121
6,651,685 B2 11/2003 Connelly et al.
6,745,521 B1 6/2004 Klemming
6,761,181 B1 7/2004 Tseng
6,772,780 B2 8/2004 Price
6,814,094 B1 11/2004 Barber
6,820,629 B2 11/2004 Tseng
6,904,923 B2 * 6/2005 Chai ..... B60J 1/2011 135/21
6,923,195 B2 8/2005 Tseng
7,025,074 B2 4/2006 Porter
7,207,344 B2 * 4/2007 Wu ..... E04H 15/58 135/158
7,219,681 B1 5/2007 Hamilton-Jones
7,308,901 B2 * 12/2007 Meyer ..... A45B 25/18 135/115
7,451,776 B2 11/2008 Chen
7,497,048 B2 * 3/2009 Bakowski ..... A01G 13/043 135/100
7,703,469 B2 4/2010 Danziger
7,806,131 B1 * 10/2010 Seiler ..... A45B 25/18 135/33.2
7,814,723 B2 10/2010 VanElverdinghe
7,921,864 B2 4/2011 Carter
8,001,986 B2 8/2011 Shumate
8,082,938 B2 12/2011 Prusmack
9,243,422 B2 1/2016 Hunt et al.
9,556,639 B2 1/2017 Hunt et al.
2006/0174929 A1 * 8/2006 Tseng ..... E04H 15/34 135/159
2006/0266401 A1 11/2006 Wu
2007/0125409 A1 * 6/2007 Cullen ..... A45B 15/00 135/33.41
2007/0215191 A1 9/2007 Huang et al.
2009/0314323 A1 12/2009 Park et al.
2010/0275962 A1 11/2010 Park et al.
2011/0308559 A1 12/2011 Ma et al.
2012/0240970 A1 9/2012 Parsons et al.
2015/0020857 A1 * 1/2015 Dominick ..... E04H 15/04 135/90
2015/0167346 A1 * 6/2015 Li ..... E04H 15/64 135/119
2017/0167158 A1 * 6/2017 Lynch ..... E04H 15/40
2018/0010361 A1 * 1/2018 Carradinha ..... E04H 15/64

OTHER PUBLICATIONS

Owner's Manual for Bay Window Gazebo, Garden Oasis Living Outdoors, manufactured by Sunjoy Industries, pp. 1-9, dated Oct. 2006.

11'×13' South Hampton Gazebo Instruction Manual, manufactured by Sunjoy Industries, pp. 1-8, dated Oct. 2004.

11'×13' New Port Gazebo Instruction Manual, manufactured by Sunjoy Industries, pp. 1-7, dated Oct. 2012.

* cited by examiner

Detail "A"

Detail "B"

Detail "C"

ROOF CANOPY FOR AN OUTDOOR SHELTER

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a roof canopy for an outdoor shelter. More particularly, the invention relates to a roof canopy for an outdoor shelter that is easier to install on roof frame members than conventional roof canopies.

2. Background and Description of Related Art

Portable outdoor shelters, such as portable gazebos, are useful for a myriad of different applications. For example, outdoor gazebos are often used for backyard patio gathering spaces. Because the outdoor gazebos are at least partially enclosed, table and chair sets may be arranged underneath the outdoor gazebos so that the individuals seated around the table may remain cooler by being shaded from direct sunlight. Also, when food is being served outside, a food serving table or tables are often placed underneath the gazebo to protect the food from direct sunlight and rain.

Although, conventional outdoor shelters often require a great deal of time to assemble because they include a large collection of constituent components that must be assembled to one another. For example, the roof canopy of a conventional outdoor shelter is often difficult to install on the roof frame of the conventional outdoor shelter. As such, the overall time required to assemble the outdoor shelter is increased.

Therefore, what is needed is a roof canopy for an outdoor shelter that is designed to be more easily installed on the roof frame members of the outdoor shelter. Moreover, a roof canopy for an outdoor shelter is needed that has reinforced corner portions in order to strengthen the corner portions of the canopy so that they are less susceptible to tearing. Furthermore, a roof canopy for an outdoor shelter is needed that reduces the stress on the corner stitching of the canopy so that the stitching is less likely to fail.

BRIEF SUMMARY OF EMBODIMENTS OF THE INVENTION

Accordingly, the present invention is directed to a roof canopy for an outdoor shelter and an outdoor shelter including the same that substantially obviates one or more problems resulting from the limitations and deficiencies of the related art.

In accordance with one or more embodiments of the present invention, there is provided a roof canopy for an outdoor shelter. The roof canopy includes a canopy fabric material configured to form a roof cover of an outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface; a pocket structure attached to the second surface of the canopy fabric material, the pocket structure including a pocket fabric sheet at least partially spaced apart from the canopy fabric material, the pocket fabric sheet and the canopy fabric material together defining a pocket cavity configured to receive an end portion of a roof frame member of the outdoor shelter therein; and a handle member attached to the first surface of the canopy fabric material, the handle member overlapping at least a portion of the canopy fabric material that partially defines the pocket cavity, the handle member configured to be grasped by a user so as to facilitate the pocket structure being fitted over the end portion of the roof frame member.

In a further embodiment of the present invention, the canopy fabric material comprises a plurality of corners, and the pocket structure is disposed in one of the plurality of corners.

In yet a further embodiment, the pocket structure is bounded on two sides thereof by respective edge portions of the canopy fabric material.

In still a further embodiment, the pocket fabric sheet of the pocket structure is triangular in shape; and wherein one vertex of the triangular-shaped pocket fabric sheet is disposed at a location where the edge portions of the canopy fabric material converge.

In yet a further embodiment, the handle member is disposed at an approximately 45 degree angle relative to the edge portions of the canopy fabric material.

In still a further embodiment, the handle member includes a first end and a second end disposed opposite to the first end, the handle member being attached to the first surface of the canopy fabric material at the first and second ends thereof, the first end of the handle member being disposed proximate to the location where the edge portions of the canopy fabric material converge, and the second end of the handle member being disposed proximate to an opening of the pocket cavity.

In yet a further embodiment, the canopy fabric material is stretchable so that the canopy fabric material is capable of being elastically deformed by the user as the pocket structure is fitted over the end portion of the roof frame member.

In accordance with one or more other embodiments of the present invention, there is provided a roof canopy for an outdoor shelter. The roof canopy includes a canopy fabric material configured to form a roof cover of an outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface; a plurality of pocket structures attached to the second surface of the canopy fabric material, each one of the plurality of pocket structures including a pocket fabric sheet at least partially spaced apart from the canopy fabric material, the pocket fabric sheet and the canopy fabric material together defining a pocket cavity configured to receive an end portion of a roof frame member of the outdoor shelter therein; and a plurality of handle members attached to the first surface of the canopy fabric material, at least one of the plurality of handle members overlapping at least a portion of the canopy fabric material that partially defines the pocket cavity, each one of the plurality of handle members configured to be grasped by a user so as to facilitate a respective one of the pocket structures being fitted over a respective one of the roof frame member end portions.

In a further embodiment of the present invention, the canopy fabric material comprises a plurality of corners, and each of the plurality of pocket structures is disposed in a respective one of the plurality of corners.

In yet a further embodiment, at least one of the plurality of pocket structures is bounded on two sides thereof by respective edge portions of the canopy fabric material.

In still a further embodiment, the pocket fabric sheet of at least one of the plurality of pocket structures is triangular in shape; and wherein one vertex of the triangular-shaped pocket fabric sheet is disposed at a location where the edge portions of the canopy fabric material converge.

In yet a further embodiment, at least one of the plurality of handle members is disposed at an approximately 45 degree angle relative to the edge portions of the canopy fabric material.

In still a further embodiment, at least one of the plurality of handle members includes a first end and a second end disposed opposite to the first end, at least one of the plurality of handle members being attached to the first surface of the canopy fabric material at the first and second ends thereof, the first end of the handle member being disposed proximate to the location where the edge portions of the canopy fabric material converge, and the second end of the handle member being disposed proximate to an opening of the pocket cavity.

In accordance with yet one or more other embodiments of the present invention, there is provided an outdoor shelter that includes a plurality of corner support members; a plurality of crossbeam members, at least one of the crossbeam members configured to be connected between a pair of the plurality of corner support members; a plurality of roof frame members, each of the roof frame members configured to be coupled to one of the plurality of corner support members or one of the plurality of crossbeam members; and a roof canopy configured to be supported by the plurality of roof frame members. The roof canopy includes a canopy fabric material configured to form a roof cover of the outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface; a pocket structure attached to the second surface of the canopy fabric material, the pocket structure including a pocket fabric sheet at least partially spaced apart from the canopy fabric material, the pocket fabric sheet and the canopy fabric material together defining a pocket cavity configured to receive an end portion of one of the plurality of roof frame members of the outdoor shelter therein; and a handle member attached to the first surface of the canopy fabric material, the handle member overlapping at least a portion of the canopy fabric material that partially defines the pocket cavity, the handle member configured to be grasped by a user so as to facilitate the pocket structure being fitted over the end portion of the roof frame member.

In a further embodiment of the present invention, the canopy fabric material of the roof canopy comprises a plurality of corners, and the pocket structure is disposed in one of the plurality of corners.

In yet a further embodiment, the pocket structure of the roof canopy is bounded on two sides thereof by respective edge portions of the canopy fabric material.

In still a further embodiment, the pocket fabric sheet of the pocket structure is triangular in shape; and wherein one vertex of the triangular-shaped pocket fabric sheet is disposed at a location where the edge portions of the canopy fabric material converge.

In yet a further embodiment, the handle member is disposed at an approximately 45 degree angle relative to the edge portions of the canopy fabric material.

In still a further embodiment, the handle member includes a first end and a second end disposed opposite to the first end, the handle member being attached to the first surface of the canopy fabric material at the first and second ends thereof, the first end of the handle member being disposed proximate to the location where the edge portions of the canopy fabric material converge, and the second end of the handle member being disposed proximate to an opening of the pocket cavity.

In yet a further embodiment, the canopy fabric material of the roof canopy is stretchable so that the canopy fabric material is capable of being elastically deformed by the user as the pocket structure is fitted over the end portion of the roof frame member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
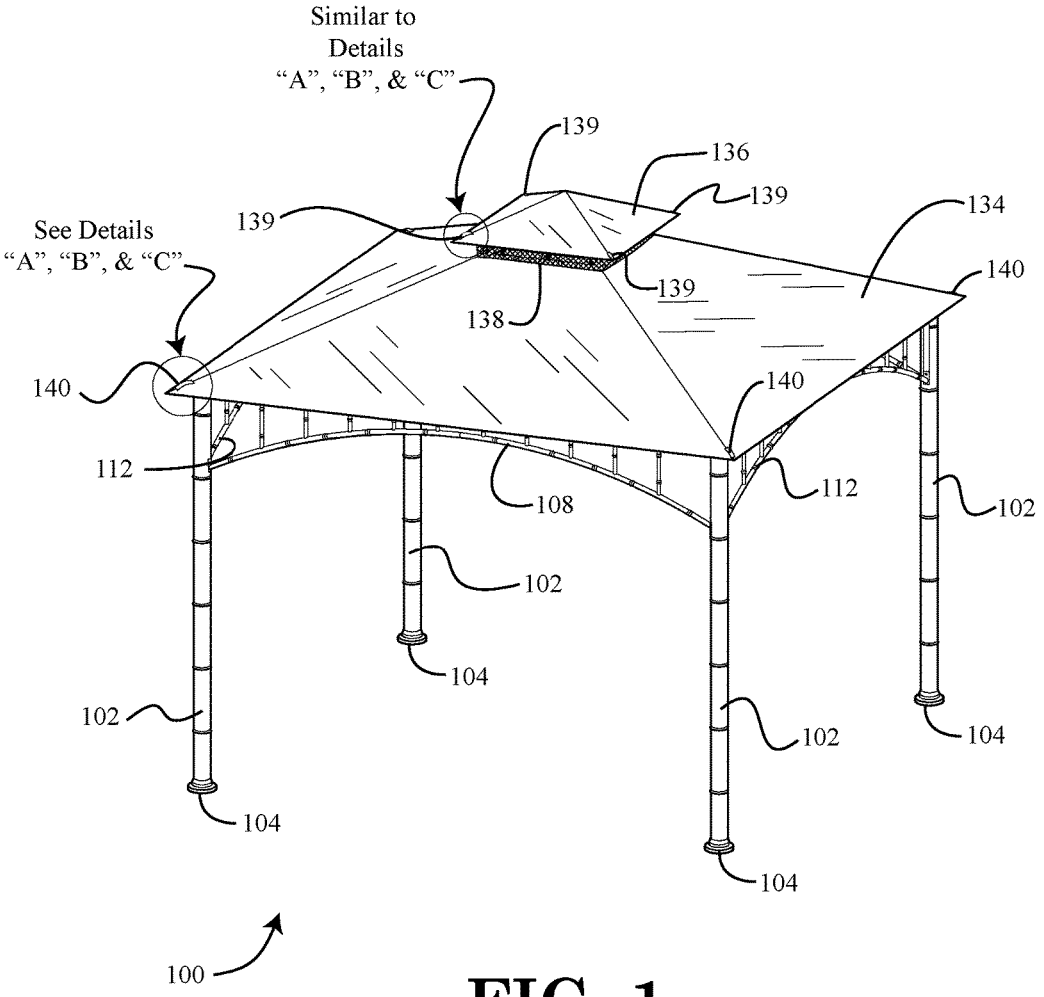
FIG. 1 is an assembled perspective view of an outdoor shelter with a roof canopy, according to an illustrative embodiment of the invention.
Figure 2:
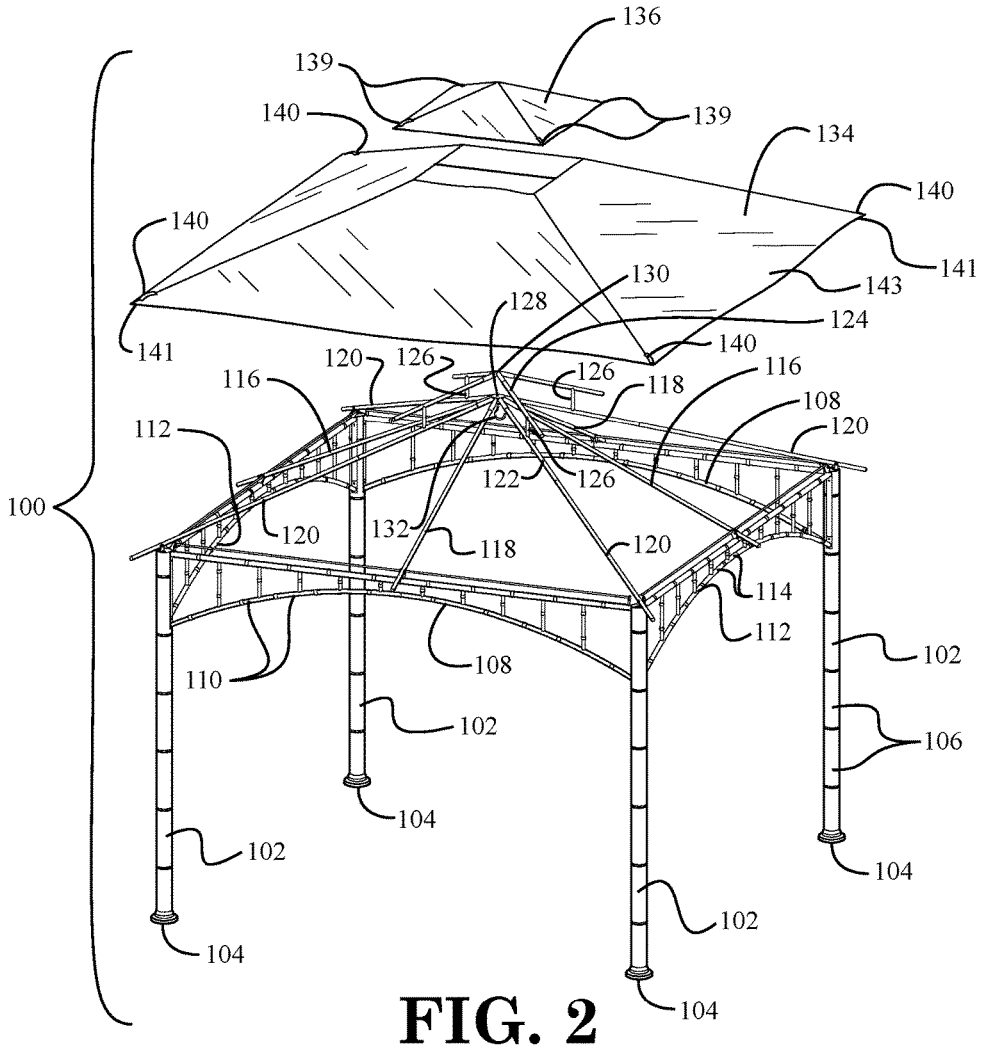
FIG. 2 is a partially exploded perspective view of the outdoor shelter of FIG. 1, wherein the central and peripheral portions of the roof canopy have been exploded from the frame structure of the outdoor shelter.

An illustrative embodiment of an outdoor shelter in the form of a gazebo is seen generally at 100 in FIGS. 1 and 2. In particular, referring to the assembled perspective view of FIG. 1 and the partially exploded perspective view of FIG. 2, it can be seen that the outdoor shelter 100 generally comprises a plurality of corner support members (e.g., corner support post members 102); a plurality of crossbeam members 108, 112, each of the crossbeam members 108, 112 configured to be connected between a pair of corner support post members 102; a plurality of roof frame members 116, 118, 120, each of the roof frame members 116, 118, 120 configured to be coupled to one of the plurality of corner support post members 102 or one of the plurality of crossbeam members 108, 112; and a roof canopy 134, 136 configured to be supported by the plurality of roof frame members 116, 118, 120. The details of the roof canopy 134, 136 of the outdoor shelter 100 will be described hereinafter.

As shown in FIGS. 1 and 2, the corner support members of the illustrated outdoor shelter 100 are in the form of corner support post members 102. With reference to these figures, it can be seen that each corner support post member 102 may include a base portion 104 and a plurality of tubular sections 106 forming the corner support post member 102. As shown in FIGS. 1 and 2, the tubular sections 106 of each corner support post member 102 may be configured to fit together so as to form the overall post member 102. Advantageously, forming the corner support post members 102 from a plurality of tubular sections 106 allows the corner support post members 102 to be more compact in their disassembled state, thereby the allowing outdoor shelter 100 to be more easily stored and transported.

Now, with reference again to the illustrative embodiment of FIGS. 1 and 2, the crossbeam members 108, 112 of the outdoor shelter 100 will be described. As shown in these figures, the outdoor shelter 100 includes a pair of first longitudinal crossbeam members 108 and a pair of second transverse crossbeam members 112. The first longitudinal crossbeam members 108 are essentially the same as the second transverse crossbeam members 112, except that the first longitudinal crossbeam members 108 have a longer length than the second transverse crossbeam members 112 (the outdoor shelter 100 has a generally rectangular shape with two longer sides and two shorter sides). As shown in FIGS. 1 and 2, each of the crossbeam members 108, 112 may include a semi-circular bottom member that is connected to a linear top member by a plurality of spaced-apart vertical members. Also, similar to that described above for the corner support post members 102, it can be seen that each longitudinal crossbeam member 108 may be formed from a plurality of tubular sections 110, and that each transverse crossbeam member 112 may be formed from a plurality of tubular sections 114. As shown in FIGS. 1 and 2, the tubular sections 110, 114 of the crossbeam members 108, 112 may be configured to fit together so as to form the overall crossbeam members 108, 112. Advantageously, forming the crossbeam members 108, 112 from a plurality of tubular sections 110, 114, allows the crossbeam members 108, 112 to be more compact in their disassembled state, thereby the allowing outdoor shelter 100 to be more easily stored and transported.

Next, turning again to FIGS. 1 and 2, the roof frame members 116, 118, 120 of the illustrative embodiment of the outdoor shelter 100 will be explained. In general, it can be seen that the roof frame members 116, 118, 120 are circumferentially spaced apart from one another so as to form a supporting structure for the roof canopy 134, 136. An upper end of each of the roof frame members 116, 118, 120 is designed to be inserted into a respective outwardly extending tubular member of a lower central connecting member 128 (see FIG. 2). As shown in the partially exploded view of FIG. 2, the lower central connecting member 128 has a central body portion with a plurality of peripheral tubular members extending outwardly therefrom. As such, the lower central connecting member 128 generally resembles an octopus, wherein the central body portion forms the body of the octopus and the peripheral tubular members form the legs of the octopus. As shown in the partially exploded perspective view of FIG. 2, each of the roof frame members 116, 118, 120 engages with a respective one of the peripheral tubular members of the lower central connecting member 128 so that a generally rigid roof structure is formed thereby.

In the illustrative embodiment, the roof framing members of the outdoor shelter include two (2) middle roof frame members 116 having a first length, two (2) middle roof frame members 118 having a second length, and four (4) corner roof frame members 120. As shown in FIG. 2, the first length of the middle roof frame members 116 is greater than the second length of the middle roof frame members 118. Also, as shown in this figure, it can be seen that each corner roof frame member 120 includes a pair of generally parallel, spaced apart lower and upper tubular members 122, 124. The lower tubular member 122 is substantially longer than the upper tubular member 124, and it supports the primary roof of the outdoor shelter 100. The short upper tubular member 124 is used to support the roof vent cover 136 in the roof of the outdoor shelter 100 (see FIG. 2). The pair of tubular members 122, 124 are connected to one another by a vertical tubular member 126, which is disposed generally perpendicular to each of the lower and upper tubular members 122, 124. The vertical tubular members 126 form the vertical gap that is required for the roof vent in the outdoor shelter 100. An upper end of each upper tubular member 124 is designed to be inserted into a respective outwardly extending tubular member of an upper central connecting member 130 (see FIG. 2), which has a structure that is similar to the lower central connecting member 128 described above. In FIG. 1, it can be seen that the roof vent may be provided with roof vent netting 138 therearound in order to prevent birds and large insects from entering the interior of the outdoor shelter 100 through the roof vent.

Initially, referring again to FIGS. 1 and 2, the roof canopy 134, 136 and other features of the outdoor shelter 100 will now be described. As best shown in FIGS. 1 and 2, a peripheral roof canopy portion 134 covers a majority of the roof framing system, while a central roof canopy portion 136 is disposed over the upper tubular members 124 of the corner roof frame members 120 that form the roof vent of the outdoor shelter 100. Together the peripheral roof canopy portion 134 and the central roof canopy portion 136 form the roof of the outdoor shelter 100. In FIG. 2, it can be seen that the underside of the lower central connecting member 128 is provided with a hook member 132 attached thereto (e.g., the end portion of the hook member 132 may be provided with a plurality of external threads that matingly engage with a plurality of internal threads on the central body portion of the lower central connecting member 128). As an example, the hook member 132 may be used for holding a hanging plant or a light inside the outdoor shelter 100.

Now, with reference to FIGS. 1-5, 6, and 8, the details of the peripheral roof canopy portion 134 of the outdoor shelter 100 will be explained. In the illustrative embodiment, the peripheral roof canopy portion 134 includes a canopy fabric material 143 (e.g., a polyester fabric—see FIGS. 2 and 6-9) configured to form a roof cover of the outdoor shelter 100, the canopy fabric material 143 having a first surface 135 (see FIG. 6) configured to face outwardly away from an interior of the outdoor shelter 100 and a second surface 137 (see FIG. 8) configured to face inwardly toward the interior of the outdoor shelter 100, the first surface 135 being oppositely disposed relative to the second surface 137; a plurality of pocket structures 150 (see FIGS. 5 and 8) attached to the second surface 137 of the canopy fabric material 143, each one of the plurality of pocket structures 150 including a pocket fabric sheet 153 at least partially spaced apart from the canopy fabric material 143, the pocket fabric sheet 153 and the canopy fabric material 143 together defining a pocket cavity 151 (see FIG. 4) configured to receive an end portion 121 of a roof frame member 120 of the outdoor shelter 100 therein (see FIG. 5); and a plurality of handle members 140 attached to the first surface 135 (see FIGS. 1, 2, and 6) of the canopy fabric material 143, each one of the plurality of handle members 140 overlapping the canopy fabric material 143 that partially defines the pocket cavity 151, and each one of the plurality of handle members 140 configured to be grasped by a user so as to facilitate a respective one of the pocket structures 150 being fitted over a respective one of the roof frame member end portions 121. In the illustrative embodiment, referring to FIG. 2, it can be seen that the canopy fabric material 143 forming the peripheral roof canopy portion 134 comprises a plurality of corners 141 (i.e., four (4) corners), and each of the plurality of pocket structures 150 is disposed in a respective one of the plurality of corners 141 (i.e., each corner 141 includes a pocket structure 150). Also, in the illustrative embodiment, a handle member 140 may be provided above each of the corner pockets 150 so as to facilitate the engagement of each pocket 150 with its respective roof frame member end portion 121. In addition, in the illustrative embodiment, a pocket structure may also be provided in approximately the middle of each side of the peripheral roof canopy portion 134 so as to accommodate a respective lower end portion of a middle roof frame member 116, 118. That is, each of these four (4) additional pocket structures are approximately centered between the corners 141 of the canopy fabric material 143 forming the peripheral roof canopy portion 134. Similar to the corner pockets 150, each of these middle pockets may be provided with a handle member disposed thereabove in order to facilitate the engagement of each middle pocket with its respective middle roof frame member end portion.

Figure 3:
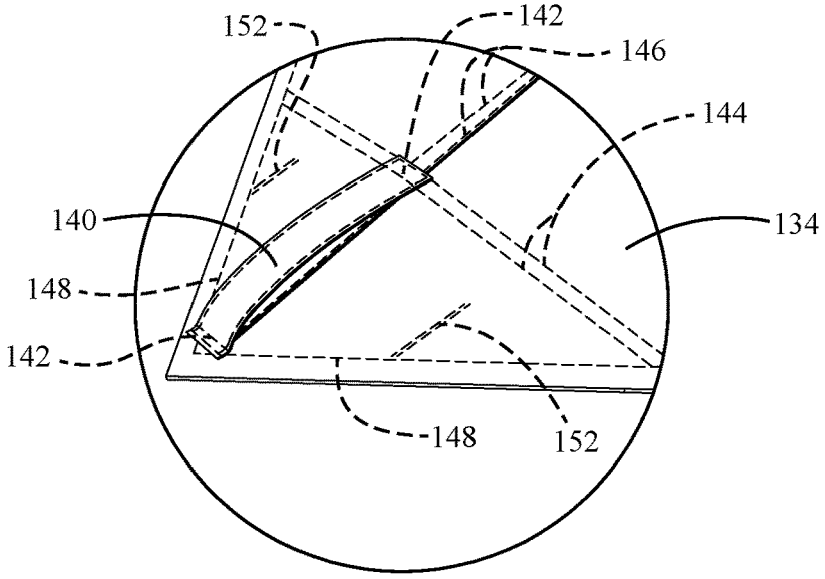
FIG. 3 is an enlarged, partial perspective view illustrating one of the corners of the peripheral roof canopy portion in FIG. 1 with a handle member provided thereon (Detail "A")
Figure 6:
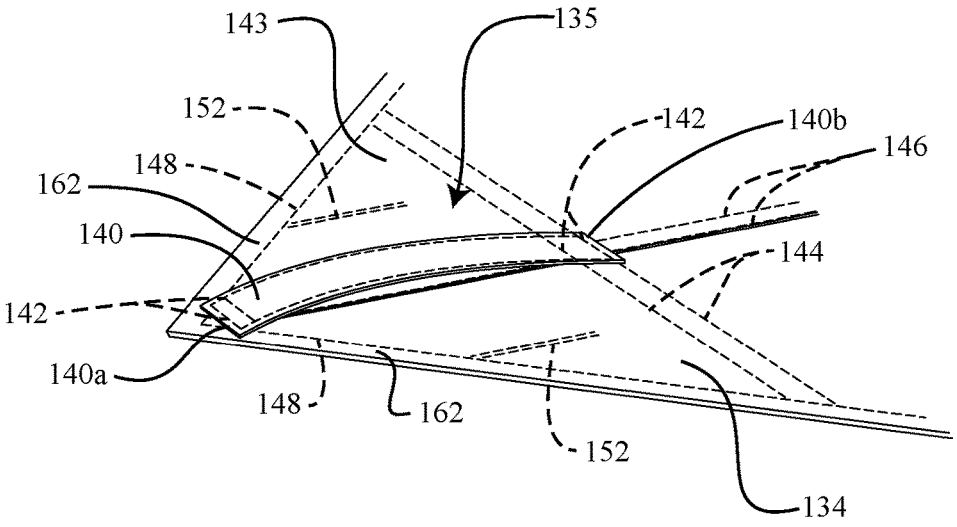
FIG. 6 is another enlarged, partial perspective view illustrating the top side of one of the corners of the peripheral roof canopy portion in FIG. 1 with a handle member provided thereon.
Figure 7:
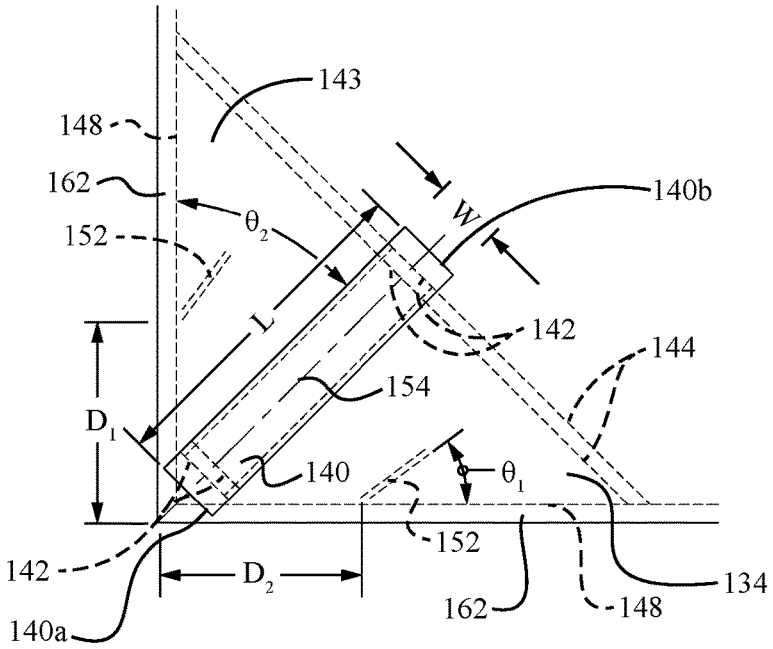
FIG. 7 is a top plan view of the top side of the corner of the peripheral roof canopy portion illustrated in FIG. 6.

Referring primarily to FIGS. 3, 6, and 7, the handle members 140 of the peripheral roof canopy portion 134 of the illustrative outdoor shelter 100 will be described. Initially, as shown in the top view of FIG. 7, which illustrates construction details that are typical for each of the handle members 140, it can be seen that the illustrated handle member 140 is disposed at an acute angle $\theta_2$ relative to the peripheral stitching 148 at the edge portions 162 of the canopy fabric material 143. In the illustrative embodiment, the acute angle $\theta_2$ is approximately equal to 45 degrees. Advantageously, the orientation angle $\theta_2$ of the handle member 140 is approximately 45 degrees in the illustrative embodiment so that the centerline 154 of the handle member 140 is generally parallel to the longitudinal axis of the corner roof frame member 120 that is configured to be received in the corner pocket 150 disposed underneath the handle member 140, thereby facilitating the insertion of the roof frame member end portion 121 into the pocket 150. With reference again to FIGS. 6 and 7, it can be seen that the handle member 140 includes a first end 140*a* and a second end 140*b* disposed opposite to the first end 140*a*. As shown in FIGS. 6 and 7, the first and second ends 140*a*, 140*b* of the handle member 140 are attached to the first surface 135 of the canopy fabric material 143 by handle stitching 142 that extends generally transversely across the handle member 140. The first end 140*a* of the handle member 140 is disposed proximate to the location where the edge portions 162 of the canopy fabric material 143 converge, and the second end 140*b* of the handle member 140 is disposed proximate to an opening of the pocket cavity 151. Each of the ends 140*a*, 140*b* of the handle member 140 comprises a pair of parallel stitches 142 that are disposed generally parallel to the transverse edges of the handle member 140.

In one exemplary embodiment, referring again to FIG. 7, the handle member 140 may have an overall length L (i.e., from its first end 140*a* to its second end 140*b*) of approximately 4.33 inches (approximately 110 millimeters) and the handle member 140 may have an overall width W of approximately 0.86 inches (approximately 22 millimeters). Although, it is to be understood that the invention is in no way limited to these particular dimensions. Rather, the invention may be practiced using any other suitable dimensions without departing from the spirit and scope of the appended claims.

Figure 5:
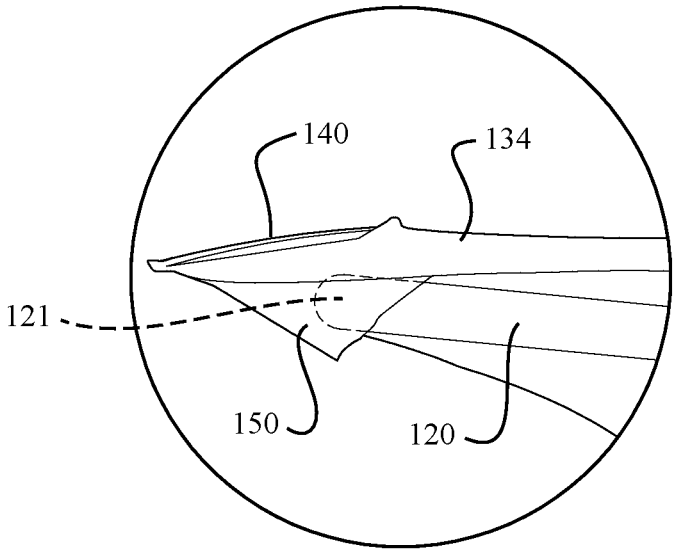
FIG. 5 is an enlarged, partial perspective view illustrating the corner of the peripheral roof canopy portion in FIG. 1 after it has been fitted over the end portion of the corner roof frame member (Detail "C")
Figure 8:
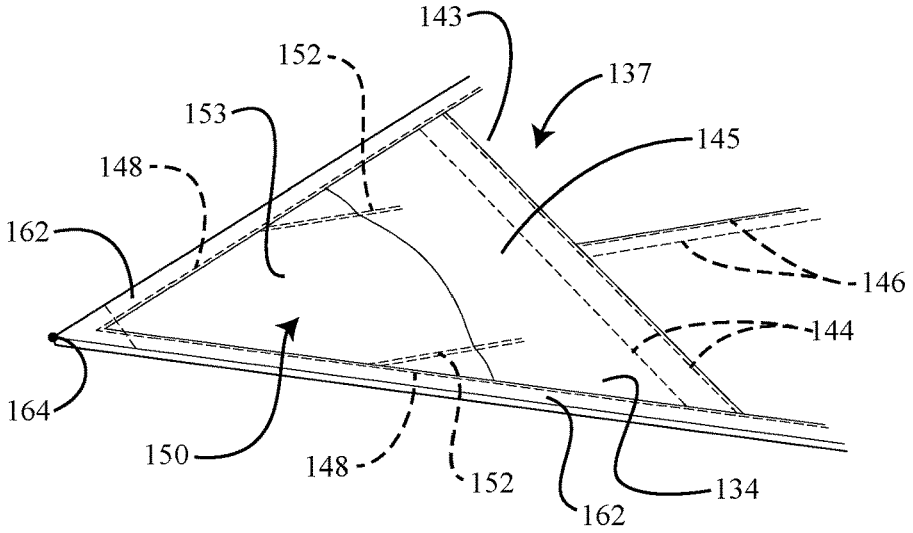
FIG. 8 is an enlarged, partial perspective view illustrating the bottom side of the corner of the peripheral roof canopy portion illustrated in FIG. 6.
Figure 9:
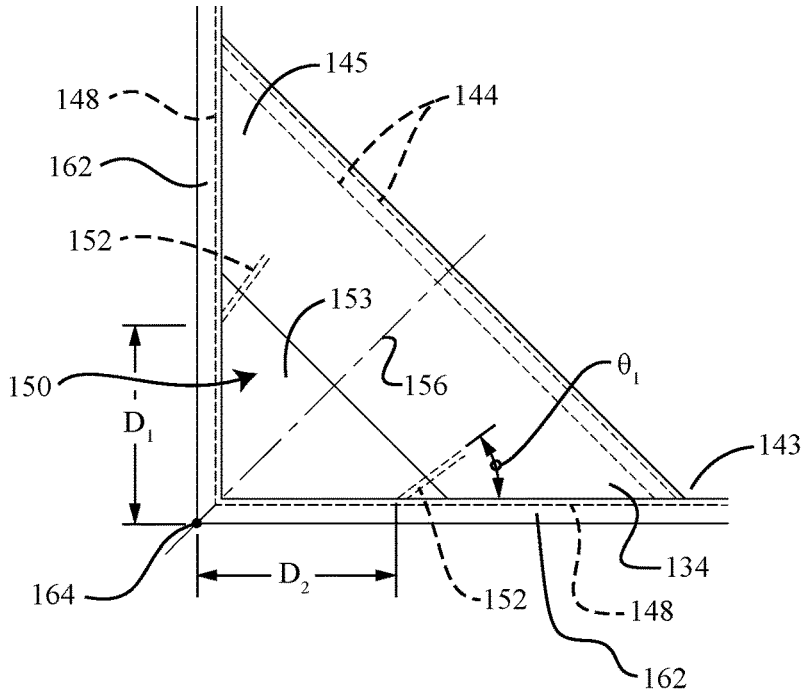
FIG. 9 is a bottom plan view of the bottom side of the corner of the peripheral roof canopy portion illustrated in FIG. 8.

Next, with reference primarily to FIGS. 5, 8, and 9, the pocket structures 150 of the peripheral roof canopy portion 134 of the illustrative outdoor shelter 100 will be explained. Initially, as best shown in FIGS. 8 and 9, which illustrates construction details that are typical for each of the pocket structures 150, it can be seen that the pocket structure 150 is bounded on two sides thereof by respective edge portions 162 of the canopy fabric material 143. Also, as shown in FIGS. 8 and 9, the pocket fabric sheet 153 of the pocket structure 150 is generally triangular in shape, and the edges of the triangular pocket fabric sheet 153 are sewn together with the edge portions 162 of the canopy fabric material 143 by means of peripheral stitching 148. In addition, it can be seen that vertex 164 of the triangular-shaped pocket fabric sheet 153, which is opposite to the pocket opening, is disposed at a location where the edge portions 162 of the canopy fabric material 143 converge. In FIG. 9, it can be seen that the centerline 156 of the pocket 150 is generally aligned with the centerline 154 of the handle member 140 such that the centerline 156 of the pocket 150 also is disposed at an angle of 45 degrees relative to the peripheral stitching 148 at the edge portions 162 of the canopy fabric material 143.

Now, with combined reference to FIGS. 6-9, the double layer construction of canopy fabric material 143 at the corners 141 of the peripheral roof canopy portion 134 will be described. As shown in these figures, the underside of the peripheral roof canopy portion 134 is provided with an additional layer of fabric 145 that is sewn to the bottom surface 137 of the primary layer of the canopy fabric material 143 so as to thicken the corner of the canopy for strength. Advantageously, by providing the additional layer of fabric 145 at the corner, if any tearing of the fabric at the canopy occurs, the additional layer 145 will tear instead of the primary canopy fabric layer, thereby preserving the integrity of the primary canopy fabric layer. As best shown in FIGS. 8 and 9, the additional layer of fabric 145 is triangular in shape. The two outer sides of the triangular fabric layer 145 (i.e., the two legs of the triangle) are sewn together with the primary canopy fabric layer of canopy fabric material 143 by means of peripheral stitching 148, while the diagonally extending side of the triangular fabric layer 145 (i.e., the hypotenuse of the triangle) is sewn together with the primary canopy fabric layer of canopy fabric material 143 by means of diagonal corner stitching 144. As illustrated in FIGS. 8 and 9, the diagonal corner stitching of the additional fabric layer 145 comprises a pair of parallel stitches 144 that are disposed at an approximately 45 degree angle relative to the peripheral stitching 148 at the edge portions 162 of the canopy fabric material 143. In addition, referring to FIGS. 6 and 8, it can be seen that the primary canopy fabric layer of canopy fabric material 143, which forms the peripheral roof canopy portion 134, further comprises diagonal stitching 146 (i.e., a pair of parallel diagonal stitches) that extend underneath the handle member 140, and terminate into the corner of peripheral roof canopy portion 134.

Turning once again to FIGS. 7 and 9, it can be seen that the corner of the peripheral roof canopy portion 134 further comprises two additional sets of angled stitches 152. Advantageously, the angled stitches 152 reduce the stress on the primary canopy stitching 148 when the corner of the peripheral roof canopy portion 134 is pulled by a user who is inserting the end portion 121 of the corner roof frame member 120 into the pocket cavity 151 (see FIG. 4). In addition, the angled stitches 152 advantageously reinforce the peripheral stitching 148 that attaches the pocket fabric sheet 153 of the pocket structure 150 to the main canopy fabric 143. As shown in FIGS. 7 and 9, the angled stitches 152 are disposed at an acute angle $\theta_1$ relative to their respective edge portions 162 of the canopy fabric material 143. In the illustrative embodiment, the acute angle $\theta_1$ is approximately equal to 37 degrees. Advantageously, the orientation angle $\theta_1$ of the stitches is approximately 37 degrees in the illustrative embodiment so that the stitches 152 are able to effectively reduce the stress on the primary canopy stitching 148 when the user pulls on the corner of the peripheral roof canopy portion 134 to insert the end roof frame member end portion 121 into the pocket cavity 151.

In one exemplary embodiment, referring again to FIGS. 7 and 9, the inner stitch of the first set of angled stitches 152 (i.e., the stitch closest to the corner) may be spaced apart from the corner vertex 164 by a distance $D_1$ equal to approximately 2.56 inches (approximately 65 millimeters). Similarly, the inner stitch of the second set of angled stitches 152 (i.e., the stitch closest to the corner) may be spaced apart from the corner vertex 164 by a distance $D_2$ that is also equal to approximately 2.56 inches (approximately 65 millimeters). Although, it is to be understood that the invention is in no way limited to these particular dimensions. Rather, the invention may be practiced using any other suitable dimensions without departing from the spirit and scope of the appended claims.

In the illustrated embodiment, the central roof canopy portion 136, which forms the top cover of the roof vent of the outdoor shelter 100, may comprise handle members and pocket structures in the corners thereof that are similar to the handle members 140 and pocket structures 150 described above for peripheral roof canopy portion 134. In particular, as shown in FIGS. 1 and 2, the central roof canopy portion 136 may comprise a handle member 139 disposed in each of the four (4) corners of the central roof canopy portion 136. Similar to that explained above for the peripheral roof canopy portion 134, the handle members 139 may be grasped by a user so as to facilitate a respective one of the pocket structures of the central roof canopy portion 136 being fitted over a respective one of the end portions of upper tubular member 124.

In the illustrative embodiment, the constituent components of the framing system of the outdoor shelter 100 (e.g., as illustrated in FIGS. 1 and 2) are formed from a suitable metallic material, such as steel, while the roof canopy portions 134, 136, the handle members 140, and the pocket structures 150 are all formed from a suitable fabric, such as a polyester fabric material. However, those of ordinary skill in the art will appreciate that other suitable materials can be used for the various components of the outdoor shelter 100 as well. In the illustrative embodiment, the canopy fabric material forming the roof canopy portions 134, 136 is stretchable so that the canopy fabric material is capable of being elastically deformed by the user as the pocket structure is fitted over the end portions of the roof frame members.

Figure 4:
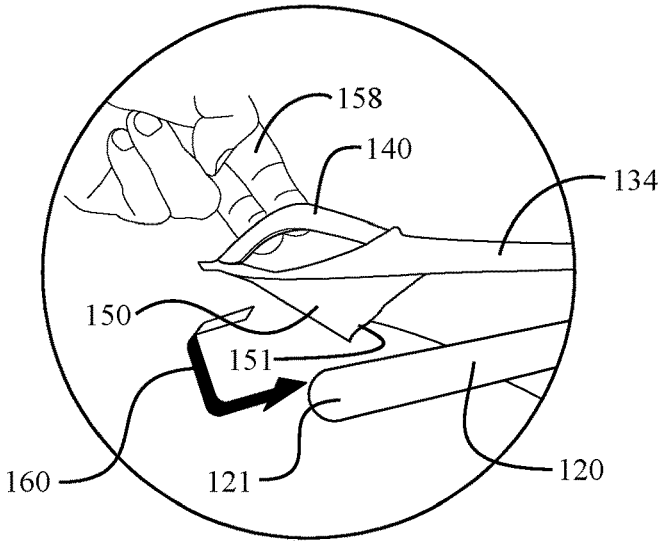
FIG. 4 is an enlarged, partial perspective view illustrating the manner in which a corner of the peripheral roof canopy portion in FIG. 1 is fitted over the end portion of one of the corner roof frame members (Detail "B")

Now, referring primarily to FIGS. 4 and 6, the manner in which the pocket structures are fitted over the end portions of the roof frame members by a user will be described. As shown in FIG. 4, grasps the handle member 140 of the roof canopy portion 134 with his or her hand 158, and elastically stretches the fabric of the roof canopy portion 134 until the end portion 121 of the corner roof frame member 120 is able to be inserted into the pocket cavity 151 of the pocket structure 150. Then, the end portion 121 of the corner roof frame member 120 is inserted into the pocket cavity 151 of the pocket structure 150 (as indicated by the directional arrow 160). After which, the elasticity of the fabric that forms the roof canopy portions 134 allows the fabric to compress so that the end portion 121 of the corner roof frame member 120 is snugly received within the pocket cavity 151 of the pocket structure 150 (refer to FIG. 5).

It is readily apparent that the aforedescribed roof canopy 134, 136 and the outdoor shelter 100 including the same offer numerous advantages. First, the roof canopy 134, 136 is designed to be more easily installed on the roof frame members of the outdoor shelter 100. In particular, it is easier for the end user to pull and hold onto the corner of the canopy using the handle member 140 so that the end portion of the roof frame member 120 can be inserted into its respective pocket cavity 151. Secondly, the roof canopy 134 has reinforced corner portions in order to strengthen the corner portions of the canopy 134 so that they are less susceptible to tearing. Finally, the innovative design of the roof canopy 134 reduces the stress on the corner stitching of the canopy so that the stitching is less likely to fail.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A roof canopy for an outdoor shelter, comprising:

a canopy fabric material configured to form a roof cover of an outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface;

a pocket structure attached to the second surface of the canopy fabric material, the pocket structure including a pocket fabric sheet at least partially spaced apart from the canopy fabric material, the pocket fabric sheet and the canopy fabric material together defining a pocket cavity configured to receive an end portion of a roof frame member of the outdoor shelter therein, the pocket structure being bounded on a first side thereof by a first edge portion of the canopy fabric material, the pocket structure further including peripheral stitching that attaches the pocket fabric sheet to the canopy fabric material and at least one angled stitch extending from the peripheral stitching toward an opening of the pocket cavity, the at least one angled stitch being disposed at an acute angle relative to the first edge portion of canopy fabric material; and a handle member attached to the first surface of the canopy fabric material, the handle member overlapping at least a portion of the canopy fabric material that partially defines the pocket cavity, the handle member configured to be grasped by a user so as to facilitate the pocket structure being fitted over the end portion of the roof frame member;

wherein the at least one angled stitch of the pocket structure is configured to reduce stress on the peripheral stitching as the pocket structure is fitted over the end portion of the roof frame member by the user.

2. The roof canopy according to claim 1, wherein the canopy fabric material comprises a plurality of corners, and the pocket structure is disposed in one of the plurality of corners.

3. The roof canopy according to claim 2, wherein the pocket structure is bounded on a second side thereof by a second edge portion of the canopy fabric material.

4. The roof canopy according to claim 3, wherein the pocket fabric sheet of the pocket structure is triangular in shape; and wherein one vertex of the triangular-shaped pocket fabric sheet is disposed at a location where the first and second edge portions of the canopy fabric material converge.

5. The roof canopy according to claim 4, wherein the handle member is disposed at an approximately 45 degree angle relative to the first and second edge portions of the canopy fabric material.

6. The roof canopy according to claim 4, wherein the handle member includes a first end and a second end disposed opposite to the first end, the handle member being attached to the first surface of the canopy fabric material at the first and second ends thereof, the first end of the handle member being disposed proximate to the location where the first and second edge portions of the canopy fabric material converge, and the second end of the handle member being disposed proximate to the opening of the pocket cavity.

7. The roof canopy according to claim 1, wherein the canopy fabric material is stretchable so that the canopy fabric material is capable of being elastically deformed by the user as the pocket structure is fitted over the end portion of the roof frame member.

8. A roof canopy for an outdoor shelter, comprising:

a canopy fabric material configured to form a roof cover of an outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface;

a plurality of pocket structures attached to the second surface of the canopy fabric material, each one of the plurality of pocket structures including a pocket fabric sheet at least partially spaced apart from the canopy fabric material, the pocket fabric sheet and the canopy fabric material together defining a pocket cavity configured to receive an end portion of a roof frame member of the outdoor shelter therein, at least one of the plurality of pocket structures being. bounded on a first side thereof by a first edge portion of the canopy fabric material, the at least one of the plurality of pocket structures further including peripheral stitching that attaches the pocket fabric sheet to the canopy fabric material and at least one angled stitch extending from the peripheral stitching toward an opening of the pocket cavity, the at least one angled stitch being disposed at an acute angle relative to the first edge portion of canopy fabric material; and a plurality of handle members attached to the first surface of the canopy fabric material, at least one of the plurality of handle members overlapping at least a portion of the canopy fabric material that partially defines the pocket cavity, each one of the plurality of handle members configured to be grasped by a user so as to facilitate a respective one of the pocket structures being fitted over a respective one of the roof frame member end portions;

wherein the at least one angled stitch of the at least one of the plurality of pocket structures is configured to reduce stress on the peripheral stitching as the at least one of the plurality of pocket structures is fitted over the end portion of the roof frame member by the user.

9. The roof canopy according to claim 8, wherein the canopy fabric material comprises a plurality of corners, and each of the plurality of pocket structures is disposed in a respective one of the plurality of corners.

10. The roof canopy according to claim 9, wherein the at least one of the plurality of pocket structures is bounded a second side thereof by a second edge portion of the canopy fabric material.

11. The roof canopy according to claim 10, wherein the pocket fabric sheet of the at least one of the plurality of pocket structures is triangular in shape; and wherein one vertex of the triangular-shaped pocket fabric sheet is disposed at a location where the first and second edge portions of the canopy fabric material converge.

12. The roof canopy according to claim 11, wherein at least one of the plurality of handle members is disposed at an approximately 45 degree angle relative to the first and second edge portions of the canopy fabric material.

13. The roof canopy according to claim. 11, wherein at least one of the plurality of handle members includes a first end and a second end disposed opposite to the first end, the at least one of the plurality of handle members being attached to the first surface of the canopy fabric material at the first and second ends thereof, the first end of the handle member being disposed proximate to the location where the first and second edge portions of the canopy fabric material converge, and the second end of the handle member being disposed proximate to the opening of the pocket cavity.

14. An outdoor shelter, comprising:

a plurality of corner support members;

a plurality of crossbeam members, at least one of the crossbeam members configured to be connected between a pair of the plurality of corner support members;

a plurality of roof frame members, each of the roof frame members configured to be coupled to one of the plurality of corner support members or one of the plurality of crossbeam members; and a roof canopy configured to be supported by the plurality of roof frame members, the roof canopy including:

a canopy fabric material configured to form a roof cover of the outdoor shelter, the canopy fabric material having a first surface configured to face outwardly away from an interior of the outdoor shelter and a second surface configured to face inwardly toward the interior of the outdoor shelter, the first surface being oppositely disposed relative to the second surface;

a pocket structure attached to the second surface of the canopy fabric material, the pocket structure including a pocket fabric sheet at least partially spaced apart from the canopy fabric material, the pocket fabric sheet and the canopy fabric material together defining a pocket cavity configured to receive an end portion of one of the plurality of roof frame members of the outdoor shelter therein, the pocket structure being bounded on a first side thereof by a first edge portion of the canopy fabric material, the pocket structure further including peripheral stitching that attaches the pocket fabric sheet to the canopy fabric material and at least one angled stitch extending from the peripheral stitching toward an opening of the pocket cavity, the at least one angled stitch being disposed at an acute angle relative to the first edge portion of canopy fabric material; and a handle member attached to the first surface of the canopy fabric material, the handle member overlapping at least a portion of the canopy fabric material that partially defines the pocket cavity, the handle member configured to be grasped by a user so as to facilitate the pocket structure being fitted over the end portion of the roof frame member;

wherein the at least one angled stitch of the pocket structure is configured to reduce stress on the peripheral stitching as the pocket structure is fitted over the end portion of the roof frame member by the user.

15. The outdoor shelter according to claim 14, wherein the canopy fabric material of the roof canopy comprises a plurality of corners, and the pocket structure is disposed in one of the plurality of corners.

16. The outdoor shelter according to claim 15, wherein the pocket structure of the roof canopy is bounded on a second side thereof by a second edge portion of the canopy fabric material.

17. The outdoor shelter according to claim 16, wherein the pocket fabric sheet of the pocket structure is triangular in shape; and wherein one vertex of the triangular-shaped pocket fabric sheet is disposed at a location where the first and second edge portions of the canopy fabric material converge.

18. The outdoor shelter according to claim 17, wherein the handle member is disposed at an approximately 45 degree angle relative to the first and second edge portions of the canopy fabric material.

19. The outdoor shelter according to claim 17, wherein the handle member includes a first end and a second end disposed opposite to the first end, the handle member being attached to the first surface of the canopy fabric material at the first and second ends thereof, the first end of the handle member being disposed proximate to the location where the first and second edge portions of the canopy fabric material converge, and the second end of the handle member being disposed proximate to the opening of the pocket cavity.

20. The outdoor shelter according to claim 14, wherein the canopy fabric material of the roof canopy is stretchable so that the canopy fabric material is capable of being elastically deformed by the user as the pocket structure is fitted over the end portion of the roof frame member.

* * * * *